US007740308B2

(12) United States Patent
Mishly

(10) Patent No.: US 7,740,308 B2
(45) Date of Patent: Jun. 22, 2010

(54) PORTABLE STOOL

(76) Inventor: Shawn Shlomo Mishly, P.O. Box 1114, New York, NY (US) 10185

( * ) Notice: Subject to any disclaimer, the term of this patent is extended or adjusted under 35 U.S.C. 154(b) by 0 days.

(21) Appl. No.: 12/202,109

(22) Filed: Aug. 29, 2008

(65) Prior Publication Data

US 2010/0052397 A1 Mar. 4, 2010

(51) Int. Cl.
*A47C 9/10* (2006.01)

(52) U.S. Cl. ..... 297/17; 297/16.2; 297/451.5; 297/461; 135/66; 248/155.2

(58) Field of Classification Search ..... 297/17, 297/451.4, 451.5, 451.6, 461, 16.2; 135/16, 135/17, 66; 248/155.2, 435
See application file for complete search history.

(56) References Cited

U.S. PATENT DOCUMENTS 448,203 A * 3/1891 Brice ..... 135/19
767,245 A * 8/1904 Rogers ..... 248/155.2
1,111,586 A * 9/1914 Hurlbert ..... 297/461
2,800,164 A * 7/1957 Chambers ..... 248/155.1
4,130,294 A * 12/1978 Walker ..... 248/155.1
4,214,770 A * 7/1980 Agins ..... 280/819
4,232,896 A * 11/1980 Caldwell ..... 297/4
4,848,712 A * 7/1989 Russell ..... 248/155.2
5,188,422 A * 2/1993 Montgomery ..... 297/195.1
5,470,038 A * 11/1995 Clark ..... 248/156
7,172,219 B2 * 2/2007 Spragg et al. ..... 280/823

* cited by examiner

*Primary Examiner*—Peter R. Brown
(74) *Attorney, Agent, or Firm*—Aaron P. McGushion

(57) ABSTRACT

The present invention provides a telescoping leg with a seat configured to collapsibly nest there within during a stowed mode and configured to be extracted and provide a seating surface atop the telescoping leg for supporting a person during a deployed mode. In a preferred embodiment of the present invention a portable stool is provided comprising a leg and a seat configured to collapse and nest within the leg during a stowed mode, the seat configured to be extracted from the leg for providing a seating surface atop the leg for supporting a person during a deployed mode. The present invention can be compacted to a small size so that is can be easily carried in a purse, bag, or pocket.

11 Claims, 4 Drawing Sheets

PORTABLE STOOL

BACKGROUND OF THE INVENTION

1. Field of the Invention

The present invention relates to a portable stool, and more particularly, to a portable stool that can be carried in a compact manner and utilized in situations of inadequate seating.

2. Description of the Related Art

It is often found that there is inadequate seating in various public and private spaces. So, more than likely, people are left standing for extending periods of time while waiting in line, waiting for public transportation, waiting at entertainment and spectator venues, and similar situations. Extending standing, while unpleasant for most, is often not recommended for certain groups, such as the elderly or those with chronic conditions.

There is wide variety of portable seats in the art. Looking first at German patent DE 20,217,785 U1 to Schneider, he shows a walking stick for hiking and such that is capable of supporting a seating structure there atop. FIGS. 3 and 7, show the seat structure with a threaded bolt (D) that is designed to engage the top of the walking stick once the handle is removed. The seat can be folded and packed away from the walking stick while not in use.

Although this seat does support the person in a seated position, there are several drawbacks to this design. Firstly, the device is not compact. One must find a place to pack the seat while not in use; and one must carry with them a walking stick to provide the needed leg. Secondly, the device is not adjustable. The height of the seat, as dictated by the walking stick length, is not adjustable. This means that the seat might be ergonomically at the incorrect height, creating discomfort and stress. A walking stick is designed at a particular length optimized for walking, which may not be a length that is optimized for seating. Therefore, this seat is inconvenient and possibly uncomfortable.

Other devices in the art can include a cane that can be converted to a stool. Such devices have several variations in design. One design includes a round seat hinged to the cane, and designed to swing out and locked in position normal to the cane, to allow a person to sit atop the seat. Again, there are several drawbacks to this design. Because the seat is not centered over the base of the foot, at the end of the cane, the stool is inherently unbalanced. Also, the seat is always visible at the side of the cane, creating an unsightly addition that may also catch on passing objects, endangering the cane user. Also, many people who do not and will not carry a cane cannot benefit from this and similar devices.

Another cane design that includes a seat has a handle that opens up, much like a butterfly, to provide a seating surface. Again, this device limits itself to those who already utilize a cane; and would not be readily used by others who could benefit from a seat. Yet another drawback of the cane stools, looking back at the walking stick, is that the proper walking height of a cane may not coincide with the proper seating height of a stool.

Accordingly, there has been a long-felt need in the art for a device and method to provide a comfortable, compact, and portable stool to provide seating in various private and public spaces. This device should be compact so that it can be easily carried by anyone without the need for a dual use product, such as a cane stool or walking stick stool. The device should have height adjustability to permit the seating of people of various heights and preferences. Additionally, this device should be easily hidden or packed away while not in use.

OBJECTS OF THE INVENTION

It is an object of the present invention to provide an improved portable stool for providing seating in various private and public spaces with inadequate seating;

It is a further object of the present invention to provide an improved portable stool that can be compactly stored when not in use;

It is again a further object of the present invention to provide an improved portable stool capable of supporting a person in a near standing position, if desired;

It is a further object of the present invention to provide an improved portable stool that has stand-alone functionality; and It is yet a further object of the present invention to provide an improved portable stool that is height adjustable;

These and other advantages and attainments of the present invention will become apparent to those skilled in the art upon a reading of the following detailed description when taken in conjunction with the drawings wherein there is shown and described an illustrative embodiment of the invention.

SUMMARY OF THE INVENTION

The present invention is directed to a novel portable stool that provides seating in various private and public spaces with inadequate seating. The present invention can be compacted to a small size, allowing the user to store the device in a purse or pack, much like a compact umbrella. The present invention is available for use by a wide variety of people, not just to those who require canes and such or those who are willing to carry a bulky chair. The present invention can be carried on person in a car at all times, deploying when needed and out of the way when stowed. The present invention also has height adjustability to satisfy user heights and preferences.

The problem of a lack of seating in various private and public spaces is solved by providing a telescoping leg with a seat configured to collapsibly nest there within during a stowed mode and configured to be extracted and provide a seating surface atop the telescoping leg for supporting a person during a deployed mode. In a preferred embodiment of the present invention a portable stool is provided comprising a leg and a seat configured to collapse and nest within the leg during a stowed mode, the seat configured to be extracted from the leg for providing a seating surface atop the leg for supporting a person during a deployed mode.

The mechanical means to provide a seat that can nest within the leg of a stool are various; and a preferred means is described here within. The primary quality that permits the nesting function is the fact that it is capable of collapsing to a size that is sufficiently small to permit its insertion into an interior space of the leg. The leg can be entirely hollow or just have an interior space sufficiently sized to accommodate the nested seat. Optionally, the seat material can be made of a foldable material, such as a fabric material (woven or non-woven, synthetic or natural), plastic material or the like. A foldable material is a means to permit the seat and its supporting frame to fold and fit nested within the leg. As used in this specification and the appended claims, the term "collapse" means to fold, wrap, compact, tilt or otherwise reduce the size or change the orientation of the seat from mode capable of supporting a person to a compacted mode such that it is able to fit within or "nest" within the leg. Likewise, the term "nest" means to be inserted into the interior or to fit within, i.e. the seat is inserted into the interior tube of the leg.

As another option, the leg can be made of a plurality of telescoping segments, in other words, a series of telescoping tubes. Each of the telescoping segments may be locked into position by a locking means that permits adjustment of the leg length in at least one of the telescoping segments. Preferably, each tube has a detent and a mating hole in the successive tube; the detent selectively locking into its corresponding hole. In this way, several tube segments can be locked together to provide the appropriate leg length. The segment at the foot of the leg may optionally have a plurality of holes or other locking means in succession to permit fine adjustment in the leg length, for example, a detent hole may be provided every inch or so.

The advantage of the multiple segments that telescope, one into the other, is that the leg can compact into a very small length (the collapsed length) approximately equal to the longest of segment during the stowed mode. This means that the total stowed length is minimal. This also means that the leg length can be changed by simply collapsing one of the segments. The seat is optionally configured to collapse to a length approximately less than the collapsed length, whereby the seat can be fully inserted into the collapsed leg during the stowed mode. So, as a result, the entire collapsed device in the stowed mode is a size roughly equal to the largest segment length. Because the seat is nested within the leg, as opposed to the prior art attaching the seat to the side or wrapping it about the leg, the present invention provides a compact seat that collapses to a simple tube shape, without the bulky external presence of the seat.

The seat is optionally comprised of a plurality of beams each hinged to a hub by a first end with a second end of each rod supporting the seat. The rods may be configured to convergently fold to permit insertion of the seat into the leg during the stowed mode. The hub can be slidably secured within the leg, the sliding of said hub permits the deployment and stowing of the seat. It is preferred that there is three support rods or other appropriate structures, the terminus of each of the rods support one corner of a triangular fabric seat.

An optional grasping means can be provided to extract the seat from the leg when transitioning from the stowed made to the deployed mode. The grasping means can be a hook, loop or other similar device that provides a portion in which to grasp. The present invention may also be provided with a gripping means to provide grip between the walking surface and the leg. This could be a rubber foot, such as those found on canes and the like. On the end opposite of the gripping means, when in the stowed mode, a cap may be provided to cover the end of the stool.

In yet another preferred embodiment of the present invention a method of sitting in an area with inadequate seating is provided, comprising the steps of providing a portable stool having a leg and a seat configured to collapse and nest within the leg, extracting the seat from within the leg to a deployed mode to provide a seating surface, and sitting on the seating surface with the leg providing support between the seat and a walking surface. Optional steps of the method could include providing an adjustable locking means for the legs and adjusting a leg length appropriate for a seating situation. Yet another optional step could include providing the leg with a plurality of telescoping segments.

LISTING OF REFERENCE NUMERALS OF FIRST-PREFERRED EMBODIMENT

| | |
|---|---|
| portable stool | 20 |
| leg | 22 |
| seat | 24 |
| detent ball | 30 |
| detent hole | 32 |
| foldable material | 34 |
| hub | 38 |
| grasping means | 40 |
| gripping means | 42 |
| telescoping segment | 44, 46, 48, 50 |
| beams | 52, 54, 56 |
| brace | 58 |
| central rod | 60 |
| cord | 62 |

DESCRIPTION OF THE PREFERRED EMBODIMENTS

The detailed descriptions set forth below in connection with the appended drawings are intended as a description of embodiments of the invention, and is not intended to represent the only forms in which the present invention may be constructed and/or utilized. The descriptions set forth the structure and the sequence of steps for constructing and operating the invention in connection with the illustrated embodiments. It is to be understood, however, that the same or equivalent structures and steps may be accomplished by different embodiments that are also intended to be encompassed within the spirit and scope of the invention.

Figure 1C:
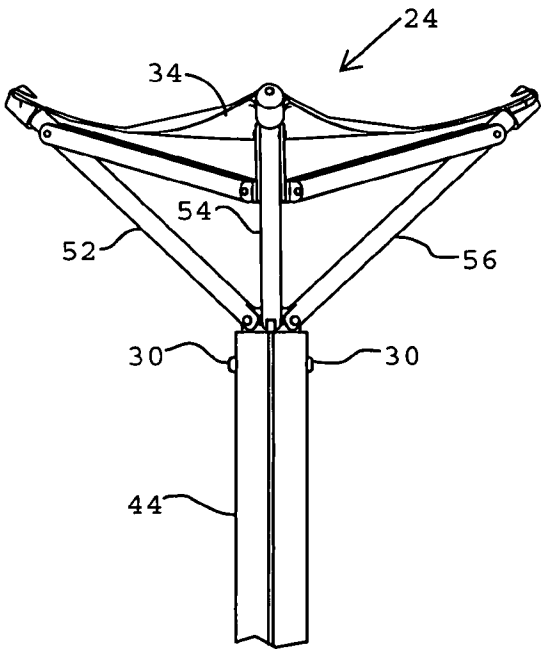
FIGS. 1A-C are side views of the preferred embodiment of the present invention, showing the deployed mode.
Figure 1B:
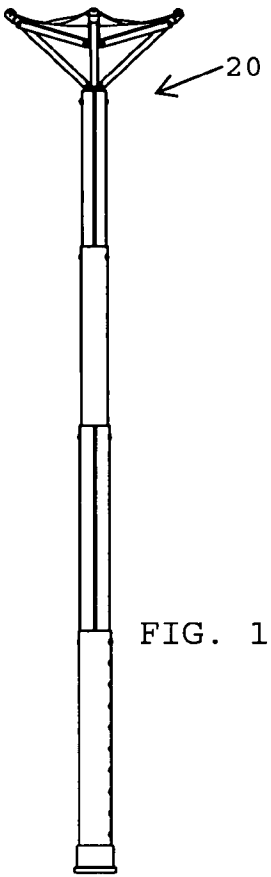
Figure 1A:
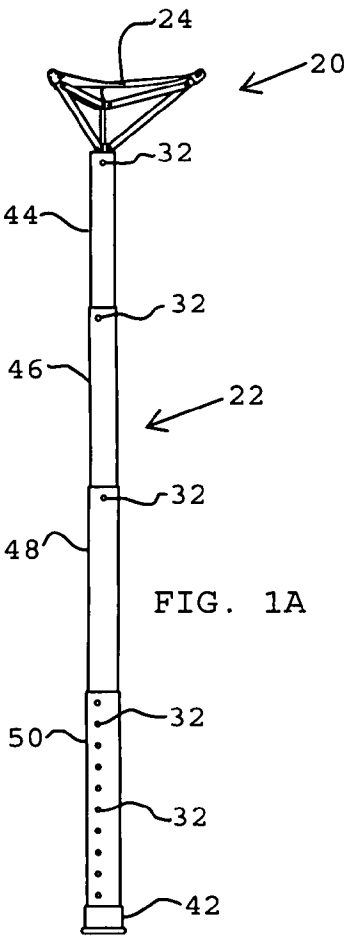
Figure 3B:
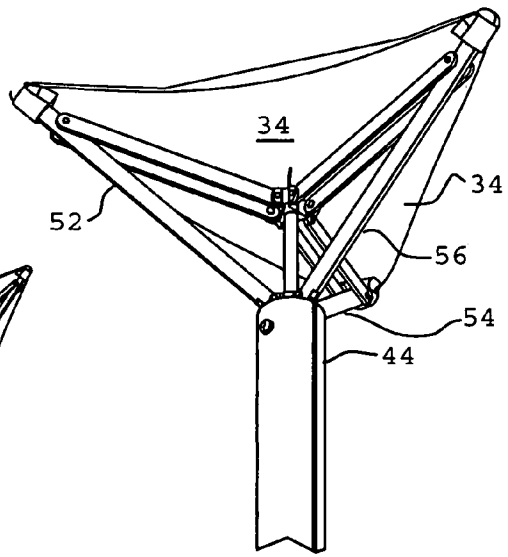
FIGS. 3A-B are bottom perspective views of the preferred embodiment of the present invention, showing the deployed mode.
Figure 3A:
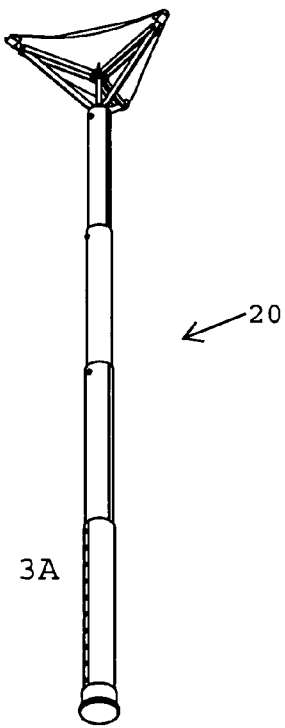
Figure 2B:
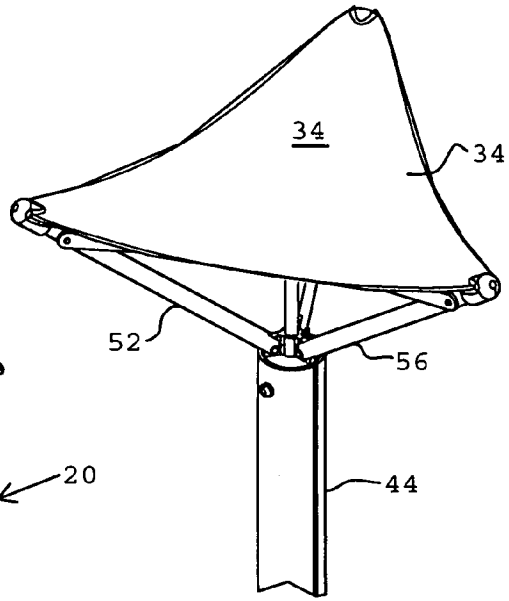
FIGS. 2A-B are top perspective views of the preferred embodiment of the present invention, showing the deployed mode.
Figure 2A:
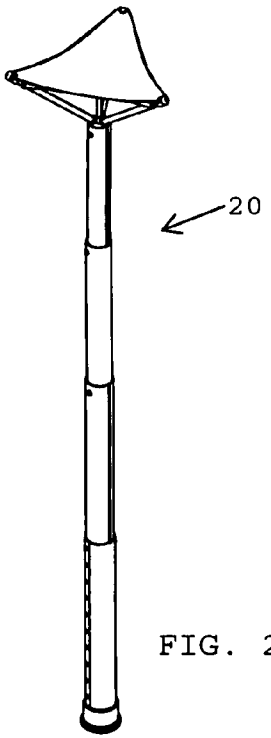

Looking first at FIGS. 1A-C the portable stool 20 in a preferred embodiment is shown in the deployed mode. The deployed mode is defined as the seat 24 being unfolded and ready to support a seated person on the seat 24 or seating surface. The stowed mode is defined as the seat 24 being folded and inserted into the leg ready to be stored. FIGS. 1A-B show the portable stool 20 fully extended with the leg 22 at its longest setting. The telescoping segment 50 at the base of the leg 22 is capped by a gripping means 42, such as a rubber foot or the like. This gripping means 42 is designed to provide grip between the leg 22 and the supporting surface. Although the gripping means 42 is not absolutely necessary for the operation of the invention, it is optionally preferred.

Again, looking at telescoping segment 50, there are numerous detent holes 32 incrementally drilled through the wall. Each detent hole 32 is designed to receive a corresponding detent ball 30 to lock the leg 22 at a desired height. The multiple detent holes 32 in segment 50 permit fine adjustment of the leg 22 height to accommodate persons of various size. It can be seen that the detent ball 30 of segment 48 locks into one of the detent holes 32 of segment 50, and each successive detent ball 30 locks into the detent hole 32 of the preceding telescoping segment (46, 48, 50). Segment 44 has a detent hole 32 configured to lock into position the seat 24 and supporting structure, although there are many options available to lock or support the seat 24 into position. The telescoping segments (44, 46, 48, 50) are preferably made of aluminum tubing, for lightless and strength, although other appropriate materials can be used.

Looking now at FIGS. 1C, 2A-B, and 3A-B, the seat 24 portion of the portable stool 20 has been magnified to more clearly show the details of the seat's 24 supporting structure. Beams (52, 54, 56) support each corner of the triangular seat 24, being made of a foldable material 34. As will be described in more detail below, the beams (52, 54, 56) are designed to fold convergently together to a size that permits the seat's 24 full insertion into the telescoping segment 44. Other designs and additional supports may be used depending on material selection and designed weight capacity.

Figure 4A:
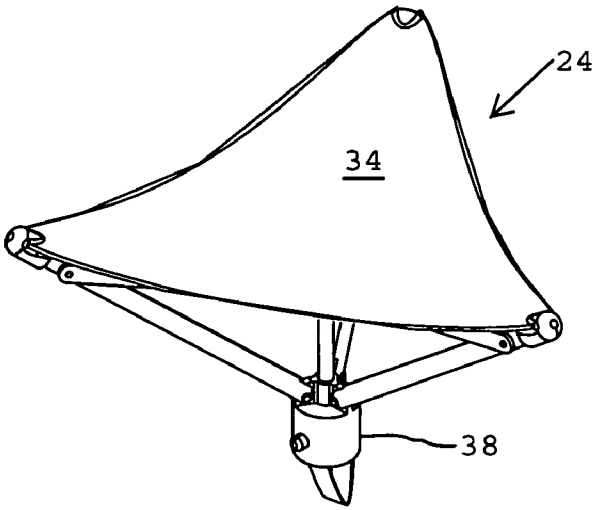
FIGS. 4A-C are partial perspective views of the preferred embodiment of the present invention, showing the seat and supporting structure detached from the portable stool.
Figure 4C:
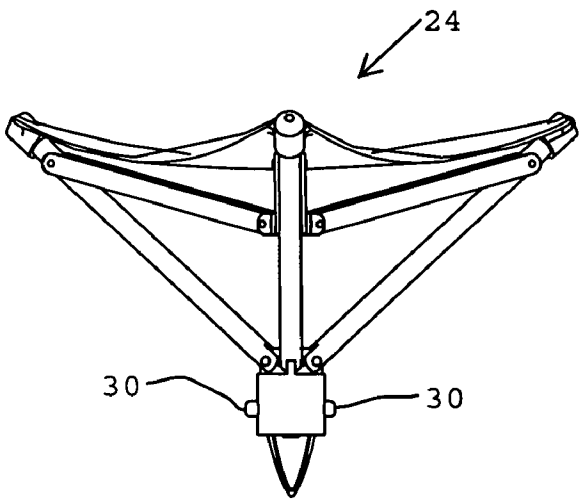
Figure 4B:
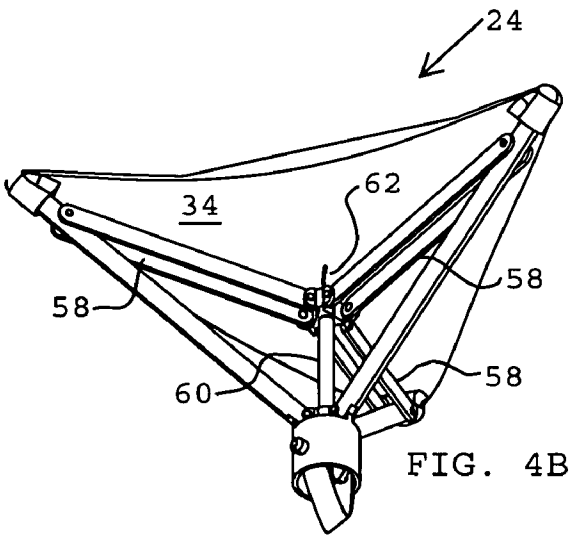

The structure of the seat 24 can be more clearly seen in FIGS. 4A-C, with the seat 24 removed from the leg 22. The hub 38 supports the beams (52, 54, 56) each through a hinged connection. Two detent balls 30 are on either side of the hub 38, so that the seat 24 can be locked into place in the deployed mode, engaging with the detent holes 32 in segment 44. As an optional design, braces 58 connecting the beams (52, 54, 56) to the central rod 60 provide additional structure and support to prevent the seat 24 from collapsing when supporting a seated person. As can be seen and as is known by those skilled in the art, the connections are hinged to permit the folding together of the beams (52, 54, 56), the braces 58 pushing down the central rod 60 relative to the hub 38. A cord 62 connects the foldable material 34 to the central rod 60, so that that during the stowing process, the central rod 60 slides downward and pulls the cord 62 along, the foldable material being pulled thereafter to a folded configuration to permit its insertion into segment 44.

Figure 5A:
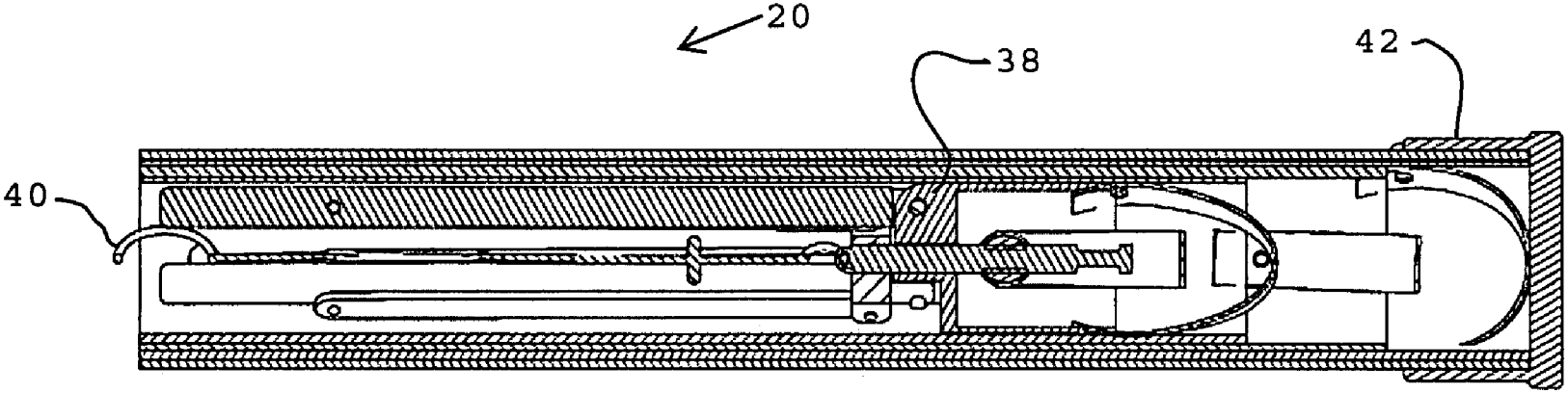
FIGS. 5A-B are side and cross sectional views of the preferred embodiment of the present invention, showing the stowed mode.
Figure 5B:
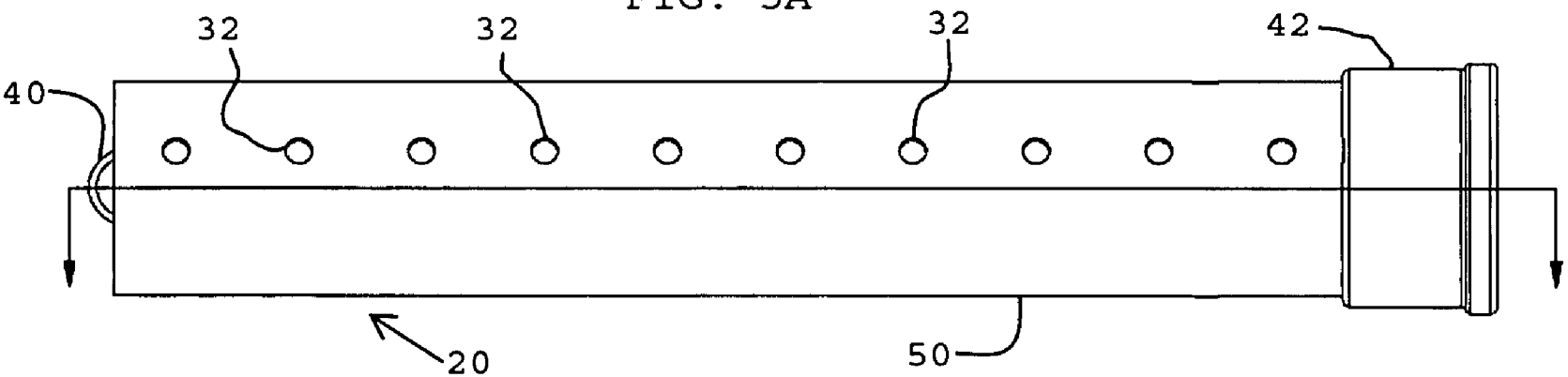

FIGS. 5A-B show the portable stool 20 in the stowed mode. Segments (44, 46, 48) are inserted into segment 50 so that the total length of the portable stool 20 in the stowed mode is approximately equal to the length of segment 50. A grasping means 40 is connected to the seat 24 to permit the user to pull the seat out of segment 50 to transition to the deployed mode. The grasping means 40 can be a plastic or rope loop, or any other suitable means to permit the user to extract the seat from segment 50.

While particular forms of the invention have been illustrated and described, it will also be apparent to those skilled in the art that various modifications can be made without departing from the spirit and scope of the invention. Accordingly, it is not intended that the invention be limited except by the claims.

What is claimed is:

1. A portable stool comprising:

a leg;

a seat made of foldable material and configured to nest within said leg during a stowed mode; said seat configured to be extracted from said leg for providing a seating surface atop said leg for supporting a person during a deployed mode;

a seat support frame configured for folding, comprising:

a hub configured to axially slide within said leg and to be selectively locked in a position relative to said leg;

a plurality of beams pivotably attached to said hub by a first end and attached to said seat by a second end;

a central rod configured to axially slide within and relative to said hub; and a plurality of braces each pivotably connected by an end to said central rod and each pivotably connected by an opposite end to one of said beams; and a cord coupling said seat to said central rod;

whereby the inward folding of said beams being coupled to said central rod through said braces causes an axial movement of said central rod thereby pulling said seat through said cord into a folded configuration to permit nesting into said leg.

2. The portable stool of claim 1 wherein said leg is comprised of a plurality of telescoping segments.

3. The portable stool of claim 2 wherein each said telescoping segment may be locked into position by a locking means, said locking means permitting adjustment of said leg length in at least one of said telescoping segments.

4. The portable stool of claim 3 wherein said locking means is a detent.

5. The portable stool of claim 2 wherein said leg is configured to telescopically collapse to a collapsed length approximately equal to one of said telescoping segments during said stowed mode.

6. The portable stool of claim 5 wherein said seat is configured to collapse to a length approximately less than said collapsed length, whereby said seat is fully inserted into said leg during said stowed mode.

7. The portable stool of claim 6 wherein in said collapsed mode the only one of the said telescoping segments is substantially exposed, said seat and remainder of said telescoping segments being substantially contained there within.

8. The portable stool of claim 1 wherein said foldable material is one of a natural fabric and a synthetic fabric.

9. The portable stool of claim 1 additionally comprising a grasping means configured to permit the extraction of said seat during transition from said stowed mode to said deployed mode.

10. The portable stool of claim 1 wherein said leg further comprising a gripping means at a terminus for providing grip between said leg and a surface.

11. A portable stool comprising:

a leg comprised of a plurality of telescoping segments;

a seat made of foldable material and configured to collapse and nest within said leg during a stowed mode; said seat configured to be extracted from said leg for providing a seating surface atop said leg for supporting a person during a deployed mode;

a seat support frame configured for folding, comprising:

a hub configured to axially slide within said leg and to be selectively locked in a position relative to said leg;

a plurality of beams pivotably attached to said hub by a first end and attached to said seat by a second end;

a central rod configured to axially slide within and relative to said hub; and a plurality of braces each pivotably connected by an end to said central rod and each pivotably connected by an opposite end to one of said beams; and a cord coupling said seat to said central rod;

whereby the inward folding of said beams being coupled to said central rod through said braces causes an axial movement of said central rod thereby pulling said seat through said cord into a folded configuration to permit nesting into said leg.

* * * * *